US009638487B1

(12) United States Patent
Liu

(10) Patent No.: US 9,638,487 B1
(45) Date of Patent: May 2, 2017

(54) SPANNING DEVICE FOR CROSSBOWS

(71) Applicant: POE LANG ENTERPRISE CO., LTD., Taichung (TW)

(72) Inventor: Chi-Chang Liu, Taichung (TW)

(73) Assignee: Poe Lang Enterprise Co., Ltd., Taichung (TW)

( * ) Notice: Subject to any disclaimer, the term of this patent is extended or adjusted under 35 U.S.C. 154(b) by 0 days.

(21) Appl. No.: 15/344,910

(22) Filed: Nov. 7, 2016

(51) Int. Cl.
*F41B 5/12* (2006.01)

(52) U.S. Cl.
CPC ..... *F41B 5/12* (2013.01)

(58) Field of Classification Search
CPC ..... F41B 5/12
See application file for complete search history.

(56) References Cited

U.S. PATENT DOCUMENTS 3,670,711 A * 6/1972 Firestone ..... F41B 5/12 124/25
3,783,852 A * 1/1974 Shepherd ..... F41B 5/12 124/22
4,649,892 A * 3/1987 Bozek ..... F41B 5/10 124/25
4,719,897 A * 1/1988 Gaudreau ..... F41B 5/1469 124/25
4,942,861 A * 7/1990 Bozek ..... F41B 5/12 124/25
5,215,069 A * 6/1993 Liu ..... F41B 5/12 124/25

* cited by examiner

*Primary Examiner* — John Ricci
(74) *Attorney, Agent, or Firm* — Rosenberg, Klein & Lee

(57) ABSTRACT

A spanning device of a crossbow includes a barrel, an action unit and an spanning unit. A space is defined in the barrel. A limb is connected close to the front end of the barrel. A string is connected between two ends of the limb. The action unit slidably located in the space and has a portion exposed from the space. The action unit has a slide, a restriction member, a safety member, a hook member and a trigger. The restriction member, the safety member, the hook member and the trigger are connected to the slide which is slidably engaged with the space. The spanning unit has a pull rod, a pivotal rod and a first link. The spanning unit drives the action unit to move in the space, so that when the hook member hooks the string, the string is easily pulled with less effort.

8 Claims, 11 Drawing Sheets

SPANNING DEVICE FOR CROSSBOWS

BACKGROUND OF THE INVENTION

1. Fields of the Invention

The present invention relates to a crossbow, and more particularly, to a spanning device for a crossbow.

2. Descriptions of Related Art

The conventional crossbows usually comprises a barrel, a limb connected to the front end of the barrel, and a stock connected to the rear end of the barrel. A string is connected between two ends of the limb. An arrow is positioned to the fighting groove in the top of the barrel and the string is pulled backward to a cocked position. The string stores energy when it is pulled or spanned backward, and the energy is released to deliver the arrow when the user pulls the trigger to release the string. It is noted that the spanning action requires a lot of effort, if the string is not successfully pulled to the cocked position, the string bounces back and may hurt the users by the string.

The present invention intends to provide a spanning device of a crossbow wherein the spanning device is easily operated to be pulled with limited force required.

SUMMARY OF THE INVENTION

The present invention relates to a spanning device of a crossbow, and comprises a barrel having a front end and a rear end. A space is defined in the barrel and located between the front end and the rear end. A grip is connected to the rear end of the barrel. A limb is connected close to the front end of the barrel and a string is connected between two ends of the limb. An action unit is slidably located in the space and has a portion exposed from the space. The action unit has a slide, a restriction member, a safety member, a hook member and a trigger. The restriction member, the safety member, the hook member and the trigger are connected to the slide which is slidably engaged with the space. The restriction member presses the safety member to restrict the safety member from being pivoted. The safety member presses the trigger to restrict the trigger from being pulled. The trigger has a first end connected to the hook member, and a second end of the trigger is exposed from the space to be pressed to shoot.

A spanning unit has a pull rod, a pivotal rod and a first link. The pull rod has a first end thereof pivotably connected to the front end of the barrel, and a second end of the pull rod is detachably connected to the grip. The pivotal rod is slidably connected to the pull rod. The pivotal rod has a first end pivotably connected to the front end of the barrel, and a second end of the pivotal rod is pivotably connected to a first end of the first link. A second end of the first link is connected to the slide of the action unit.

When the second end of the pull rod is detached from the grip, the pull rod is pulled toward the front end of the barrel and drives the pivotal rod and the first link. The action unit moves within the space from the rear end toward the front end of the barrel to pivot the hook member backward by the string. The hook member returns to its initial position when the string moves over the hook member. The pull rod is pulled toward the rear end of the barrel and drives the pivotal rod and the first link to drive the action unit to move within the space from the front end toward the rear end. The hook member hooks the string and the string is pulled toward the rear end of the barrel, and the pull rod is connected to the grip. An arrow is installed to the barrel and contacts the string. The arrow contacts the restriction member. The restriction member releases restriction to the safety member so that the safety member is pushed toward the front end of the barrel to release restriction to the trigger. The trigger is pulled to pivot the hook member to release the string to shoot the arrow.

Preferably, the slide has a first slot, and the slide has a portion located in the space, and another portion of the slide is exposed from the space. The hook member has a hooked portion, an action rod and an operation member. The hooked portion hooks the string. The action rod is located between the hooked portion and the operation member. The operation member is located in the first slot. The trigger has a driving portion, a restriction area and a pull portion. The restriction area is located between the driving portion and the pull portion. The driving portion is connected to the action rod to drive the hook member. A recovery spring is located between the action rod and the operation member. The recovery spring is biased between the hook member and the slide. The recovery spring provides a force to return the hook member. The safety member has an engaging portion and a push portion. The engaging portion presses the restriction area of the trigger to restrict the trigger. The push portion controls the engaging portion to be engaged with and disengaged from the restriction area. The restriction member has a first end exposed from the space, and a second end of the restriction member has a restriction portion which presses the push portion of the safety member to restrict the push portion. A resilient member is located between the slide and the restriction member so as to bias the restriction member to press the push portion of the safety member.

Preferably, the space includes two sidewalls and each sidewall has a rail. The slide has multiple rods which are slidably engaged with the rails.

Preferably, the rods each have a pivot. The pivotal rod has a second slot. The pivot is slidably engaged with the second slot.

Preferably, the first end of the pull rod has a pawl. The grip has a pin on the underside of the grip. The pawl is detachably connected with the pin.

Preferably, the second end the pull rod has a recess. A compression spring is biased between the recess and the pawl to return the pawl.

Preferably, the pawl has an inclined guide surface which guides the pawl to connect to the pin.

Preferably, a plate is connected to the slide and located close to the trigger. The second end of the first link is connected to a second link. At least one bolt connects the second link to the plate so that when the pull rod is moved, the action unit is driven in the space.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
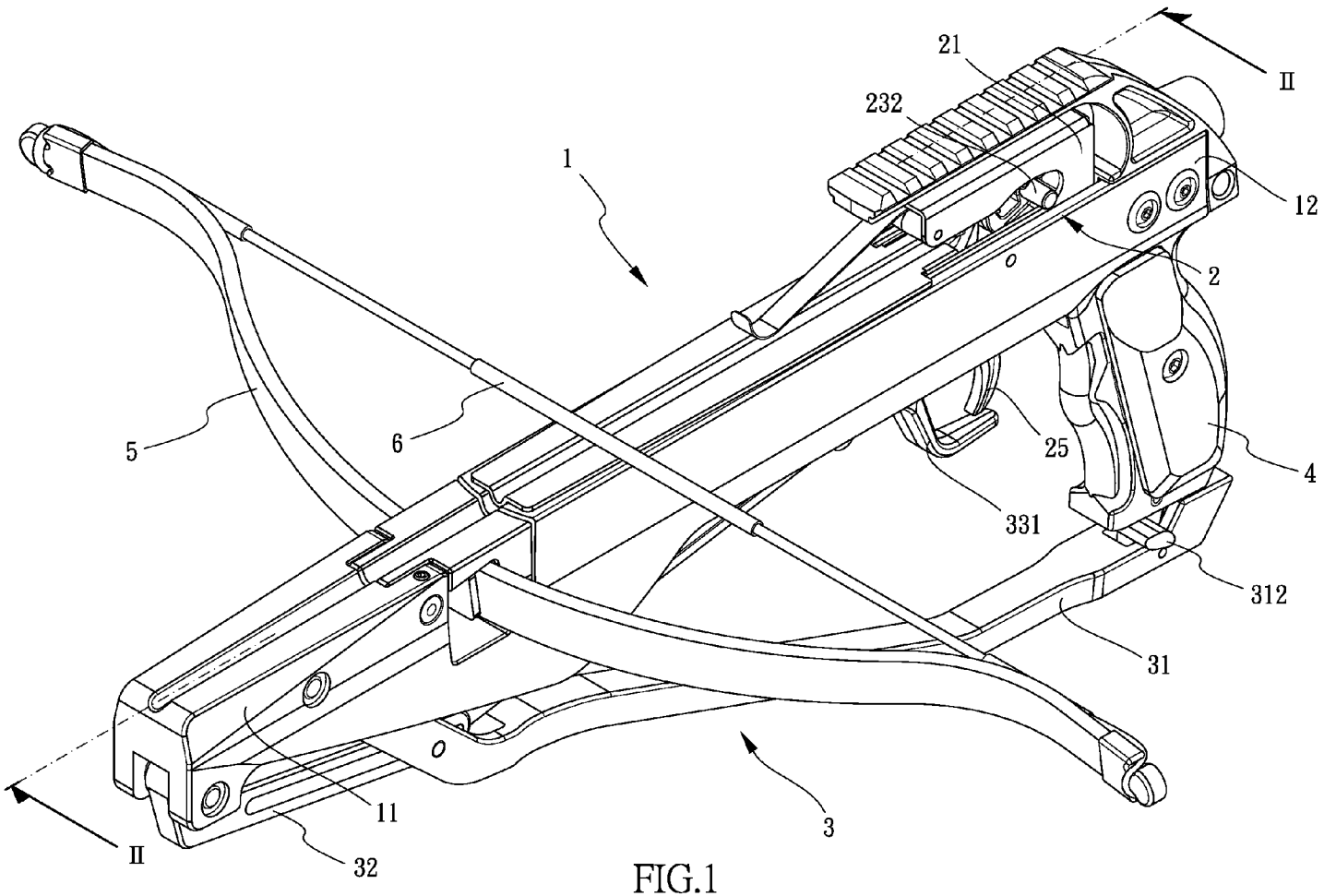
FIG. 1 is a perspective view to show a crossbow with the spanning device of the present invention installed thereto.

Referring to FIGS. 1 to 11, the spanning device of the present invention comprises a barrel 1 which has a front end 11 and a rear end 12, and a space 13 is defined in the barrel 1 and located between the front end 11 and the rear end 12. A grip 4 is connected to the rear end 12 of the barrel 1. A limb 5 is connected close to the front end 11 of the barrel 1. A string 6 is connected between two ends of the limb 5.

An action unit 2 is slidably located in the space 13 and has a portion exposed from the space 13. The action unit 2 has a slide 21, a restriction member 22, a safety member 23, a hook member 24 and a trigger 25, wherein the restriction member 22, the safety member 23, the hook member 24 and the trigger 25 are connected to the slide 21 which is slidably engaged with the space 13. The restriction member 22 presses the safety member 23 to restrict the safety member 23 from being pivoted. The safety member 23 presses the trigger 25 to restrict the trigger 25 from being pulled. The trigger 25 has a first end connected to the hook member 24, and a second end of the trigger 25 is exposed from the space 13 so that the user presses the trigger 25 to shoot.

A spanning unit 3 has a pull rod 31, a pivotal rod 32 and a first link 33. The pull rod 31 has a first end thereof pivotably connected to the front end 11 of the barrel 1, and a second end of the pull rod 31 is detachably connected to the grip 4. The pivotal rod 32 is slidably connected to the pull rod 31. The pivotal rod 32 has a first end pivotably connected to the front end of the barrel 1, and a second end of the pivotal rod 32 is pivotably connected to a first end of the first link 33. A second end of the first link 33 is connected to the slide 21 of the action unit 2.

When the second end of the pull rod 31 is detached from the grip 4, the pull rod 31 is pulled toward the front end of the barrel 1 and drives the pivotal rod 32 and the first link 33. The action unit 2 moves within the space 13 from the rear end 12 toward the front end 11 of the barrel 1 to pivot the hook member 24 backward by the string 6. The hook member 24 returns to its initial position when the string 6 moves over the hook member 24. The pull rod 31 is pulled toward the rear end 12 of the barrel 1 and drives the pivotal rod 32 and the first link 33 to drive the action unit 2 to move within the space 13 from the front end 11 toward the rear end 12. The hook member 24 hooks the string 6, and the string 6 is pulled toward the rear end 12 of the barrel 1, and the pull rod 31 is connected to the grip 4. An arrow 7 is installed to the barrel 1 and contacts the string 6. The arrow 7 contacts the restriction member 22, and the restriction member 22 releases restriction to the safety member 23 so that the safety member 23 is pushed toward the front end 11 of the barrel 1 to release restriction to the trigger 25. The trigger 25 is then pulled to pivot the hook member 24 to release the string 6 to shoot the arrow 7.

Figure 2:
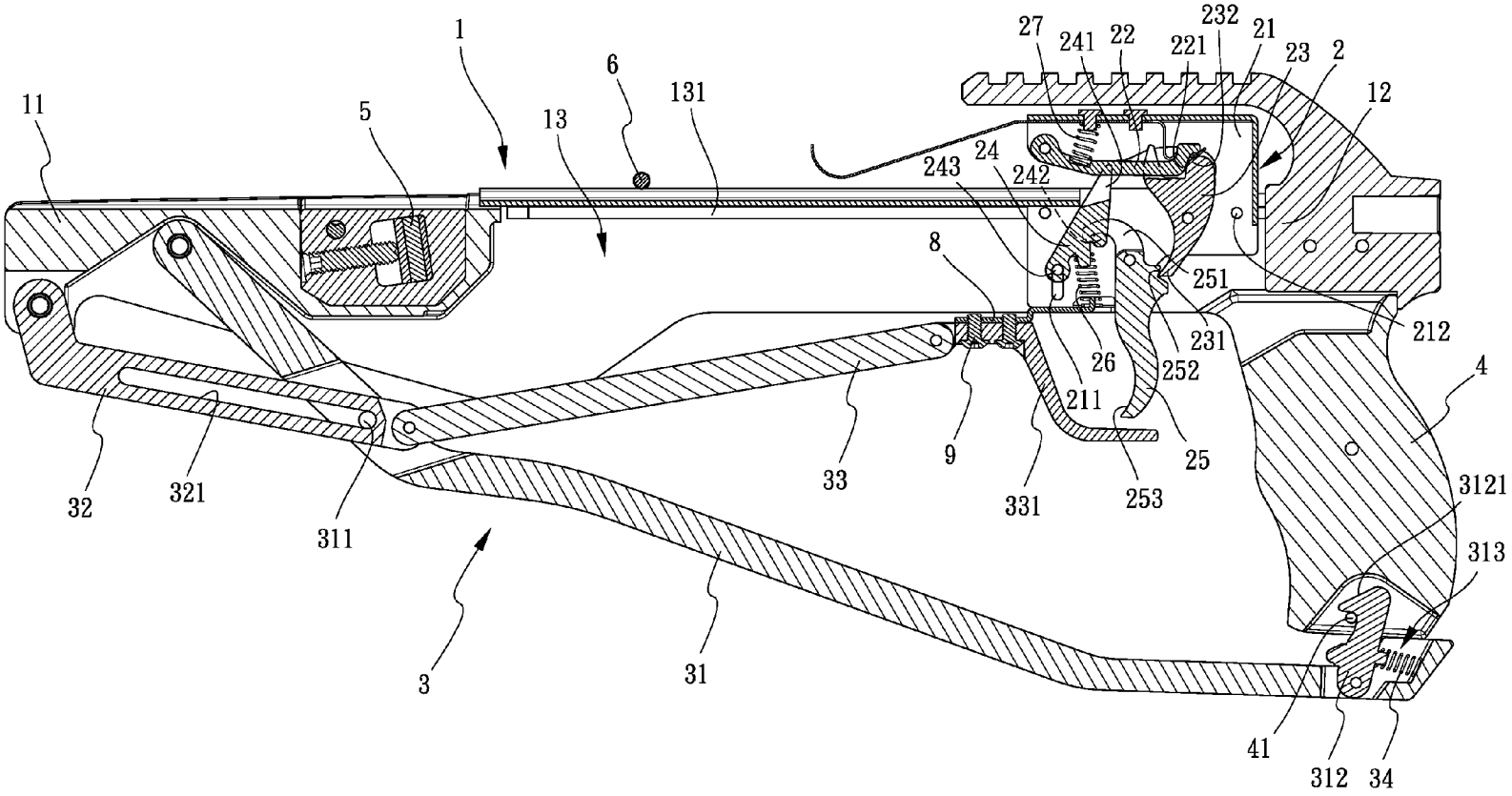
FIG. 2 is a cross sectional view, taken along line II-II in FIG. 1.
Figure 3:
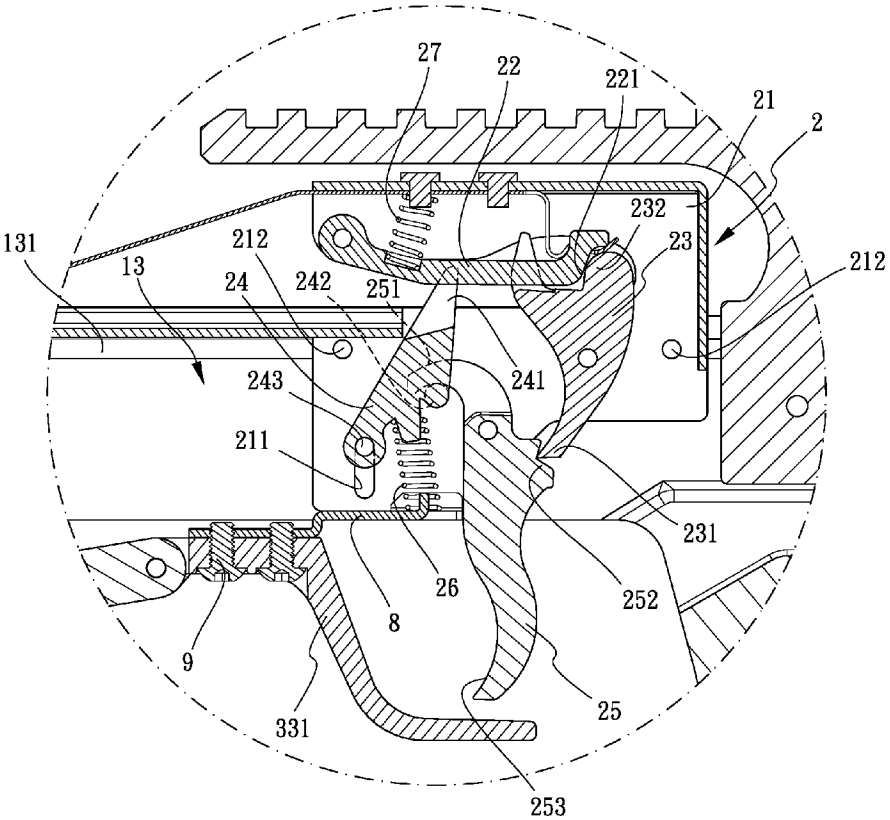
FIG. 3 is an enlarged cross sectional view of the action unit of the spanning device of the present invention.

As shown in FIGS. 1 to 3, the slide 21 has a first slot 211, and the slide 21 has a portion located in the space 13, and another portion of the slide 21 is exposed from the space 13. The hook member 24 has a hooked portion 241, an action rod 242 and an operation member 243. The hooked portion 241 hooks the string 6. The action rod 242 is located between the hooked portion 241 and the operation member 243. The operation member 243 is located in the first slot 211. The trigger 25 has a driving portion 251, a restriction area 252 and a pull portion 253. The restriction area 252 is located between the driving portion 251 and the pull portion 253. The driving portion 251 is connected to the action rod 242 to drive the hook member 24. A recovery spring 26 is located between the action rod 242 and the operation member 243. The recovery spring 26 is biased between the hook member 24 and the slide 21. The recovery spring 26 provides a force to return the hook member 24. The safety member 23 has an engaging portion 231 and a push portion 232. The engaging portion 231 presses the restriction area 252 of the trigger 25 to restrict the trigger 25. The push portion 232 controls the engaging portion 231 to be engaged with or disengaged from the restriction area 252. The restriction member 22 has a first end exposed from the space 13, and a second end of the restriction member 22 has a restriction portion 221 which presses the push portion 232 of the safety member 23 to restrict the push portion 232. A resilient member 27 is located between the slide 21 and the restriction member 22 so as to bias the restriction member 22 to press the push portion 232 of the safety member 23.

The space 131 includes two sidewalls and each sidewall has a rail 131. The slide 21 has multiple rods 212 which are slidably engaged with the rails 131.

As shown in FIG. 2, the pull rod 31 has a pivot 311. The pivotal rod 32 has a second slot 321. The pivot 311 is slidably engaged with the second slot 321. When the pull rod 31 is in action, the pivot 311 is slidably engaged with the second slot 321 to drive the pivotal rod 32 as shown in FIGS. 4-8.

The first end of the pull rod 31 has a pawl 312. The grip has a pin 41 on the underside of the grip 4. The pawl 312 is detachably connected with the pin 41. When pressing the pawl 312, the pull rod 31 is dis-connected from the grip 4 by the separation between the pawl 312 and the pin 41.

Figure 4:
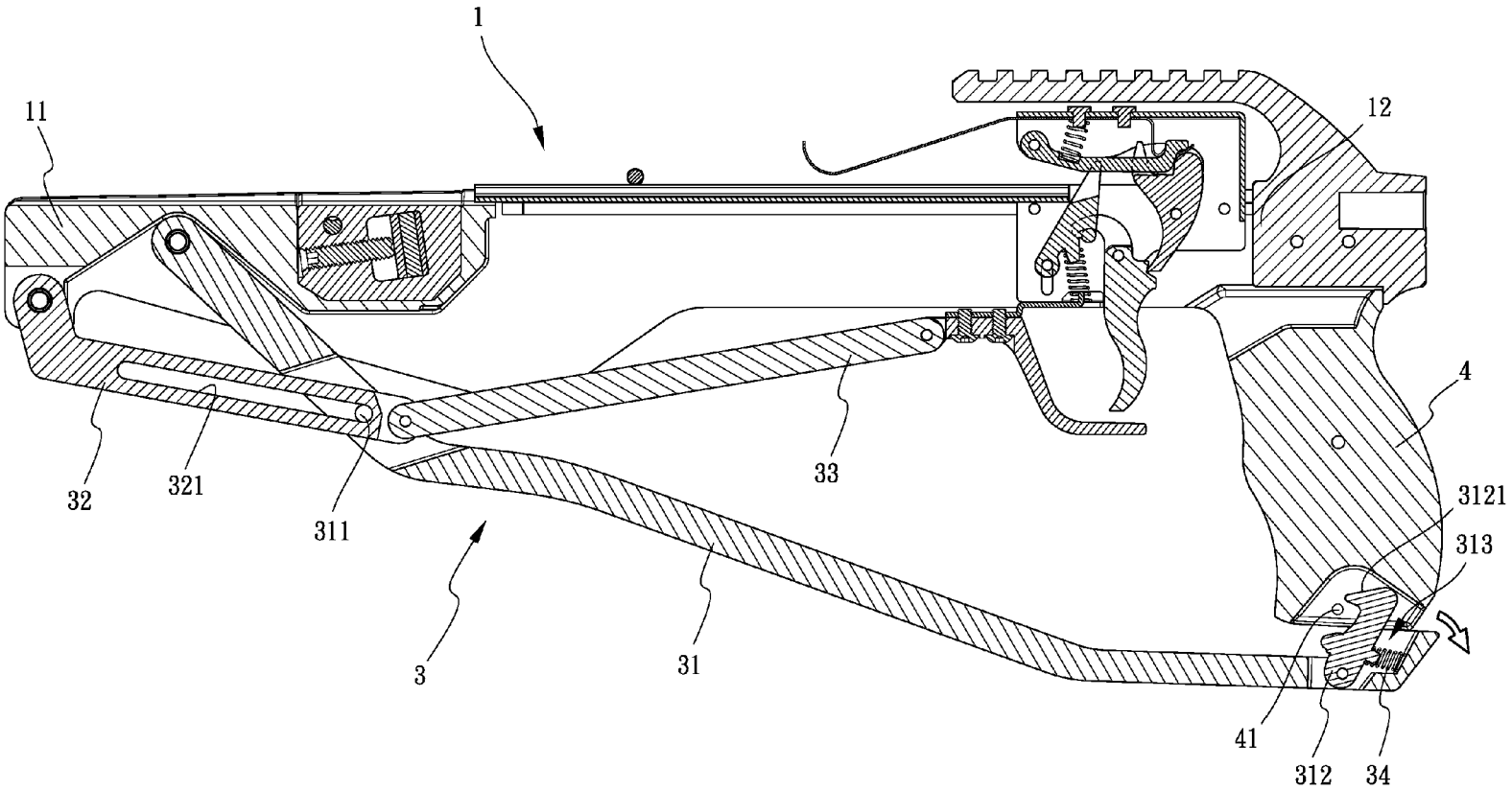
FIGS. 4-11 are operational status of the spanning device of the present invention.
Figure 5:
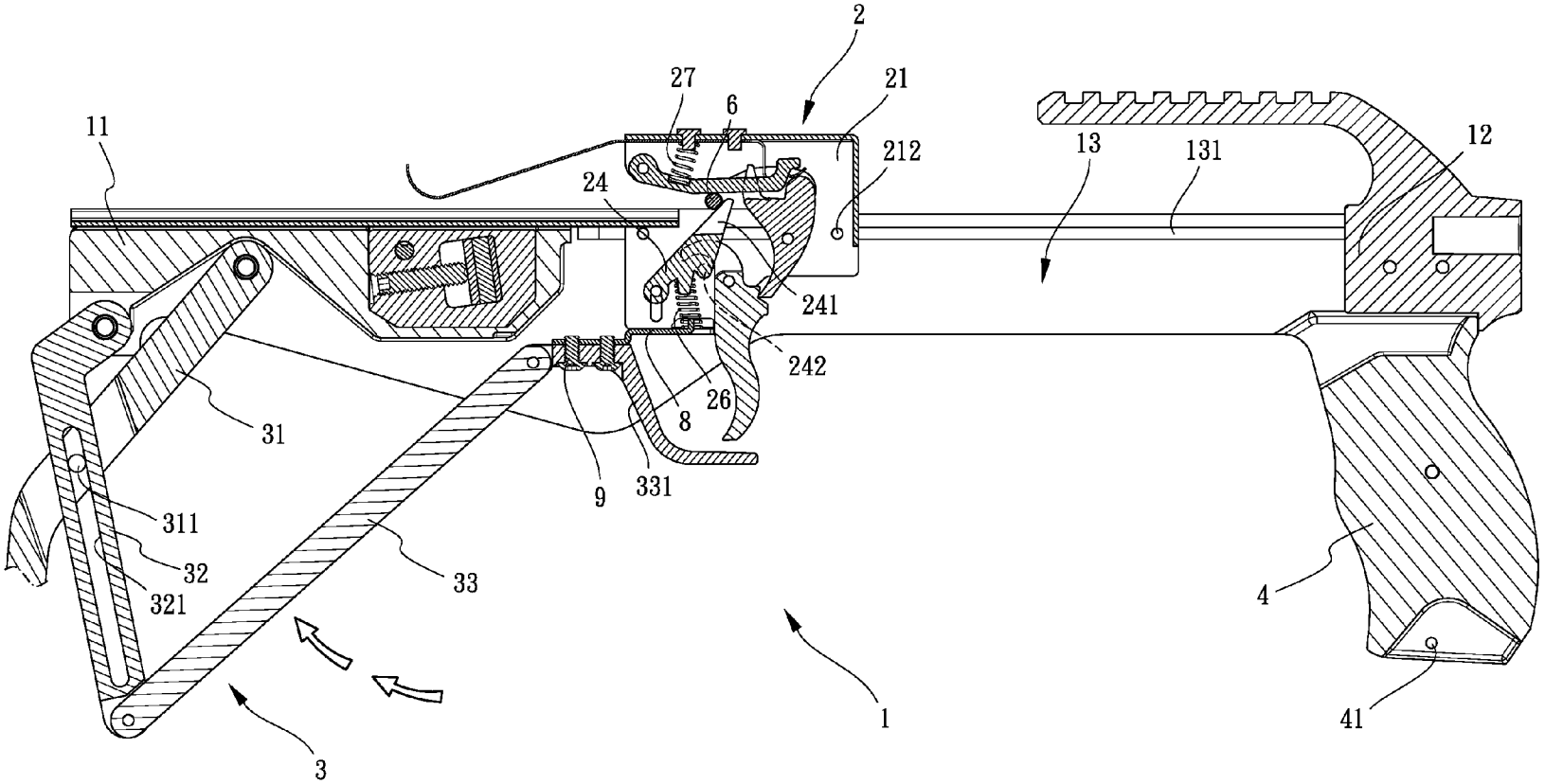
Figure 6:
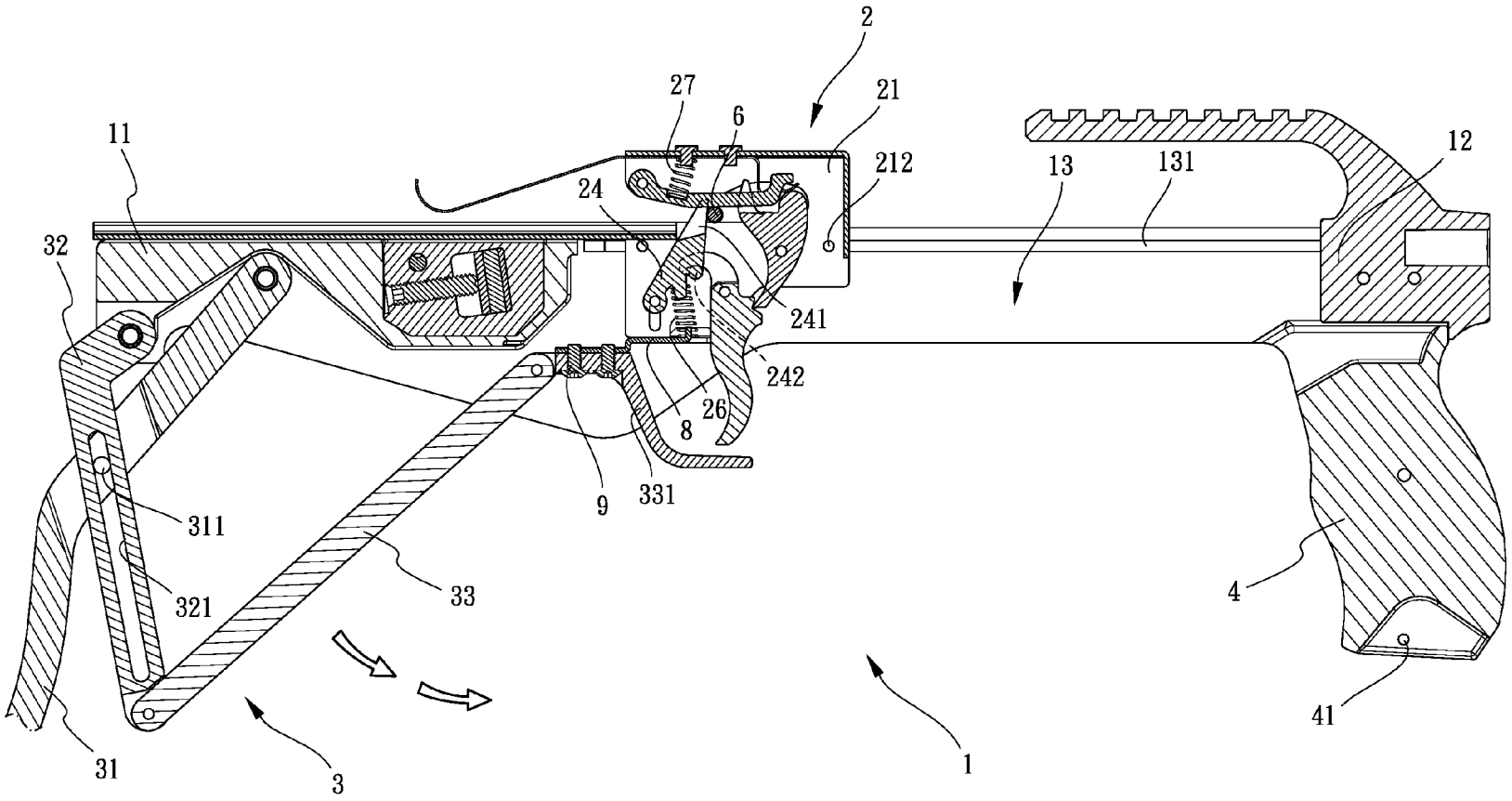
Figure 7:
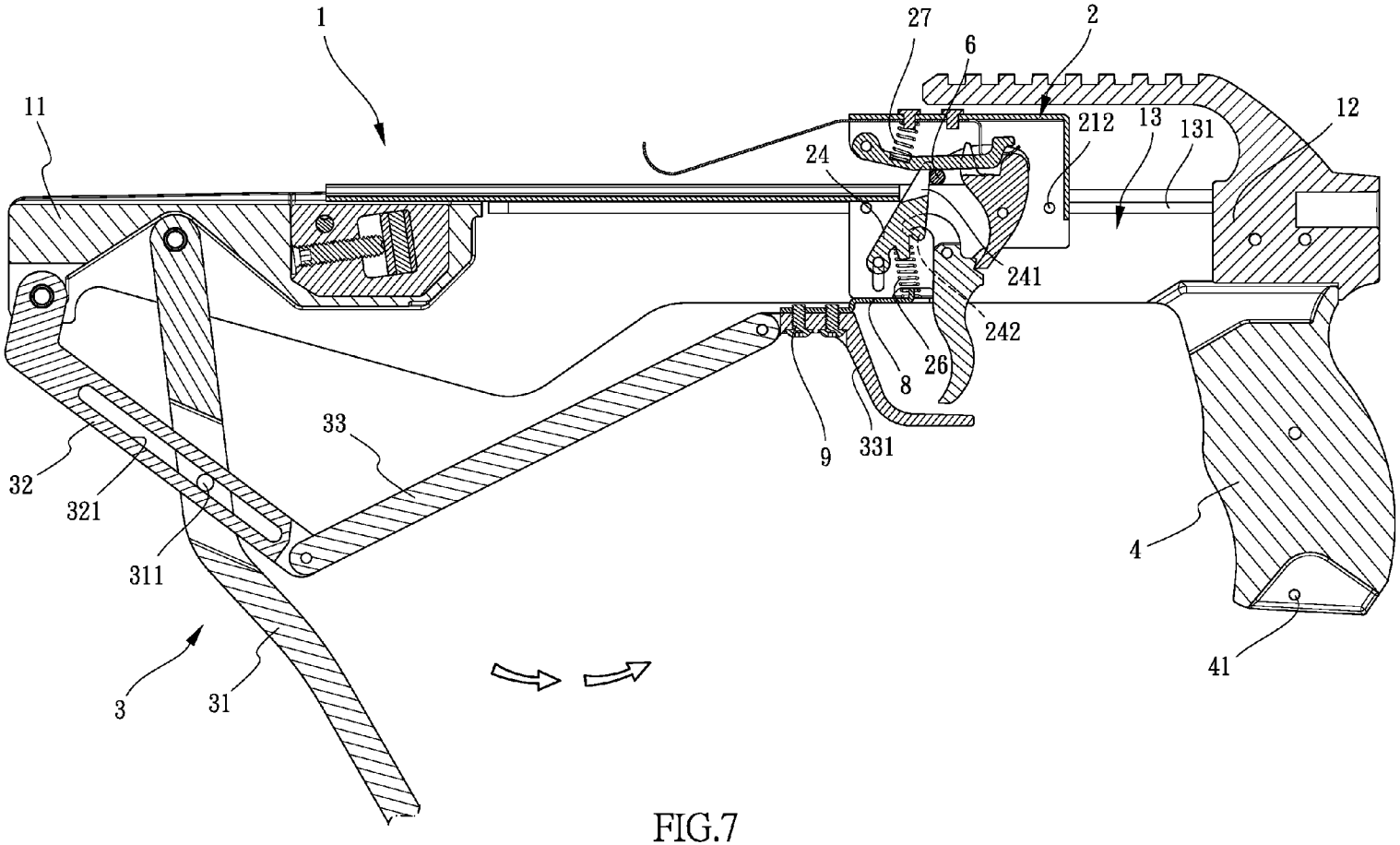
Figure 8:
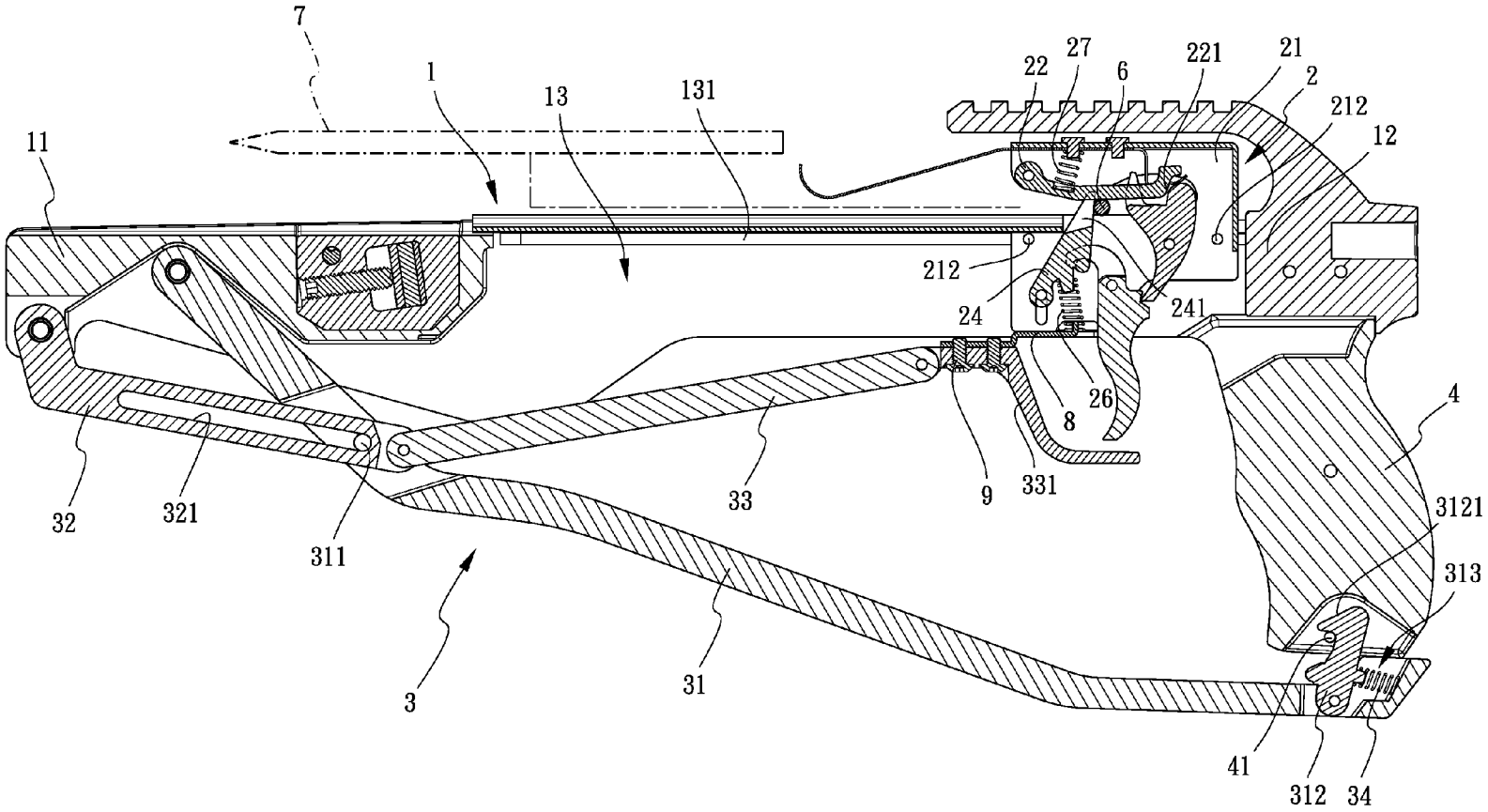
Figure 9:
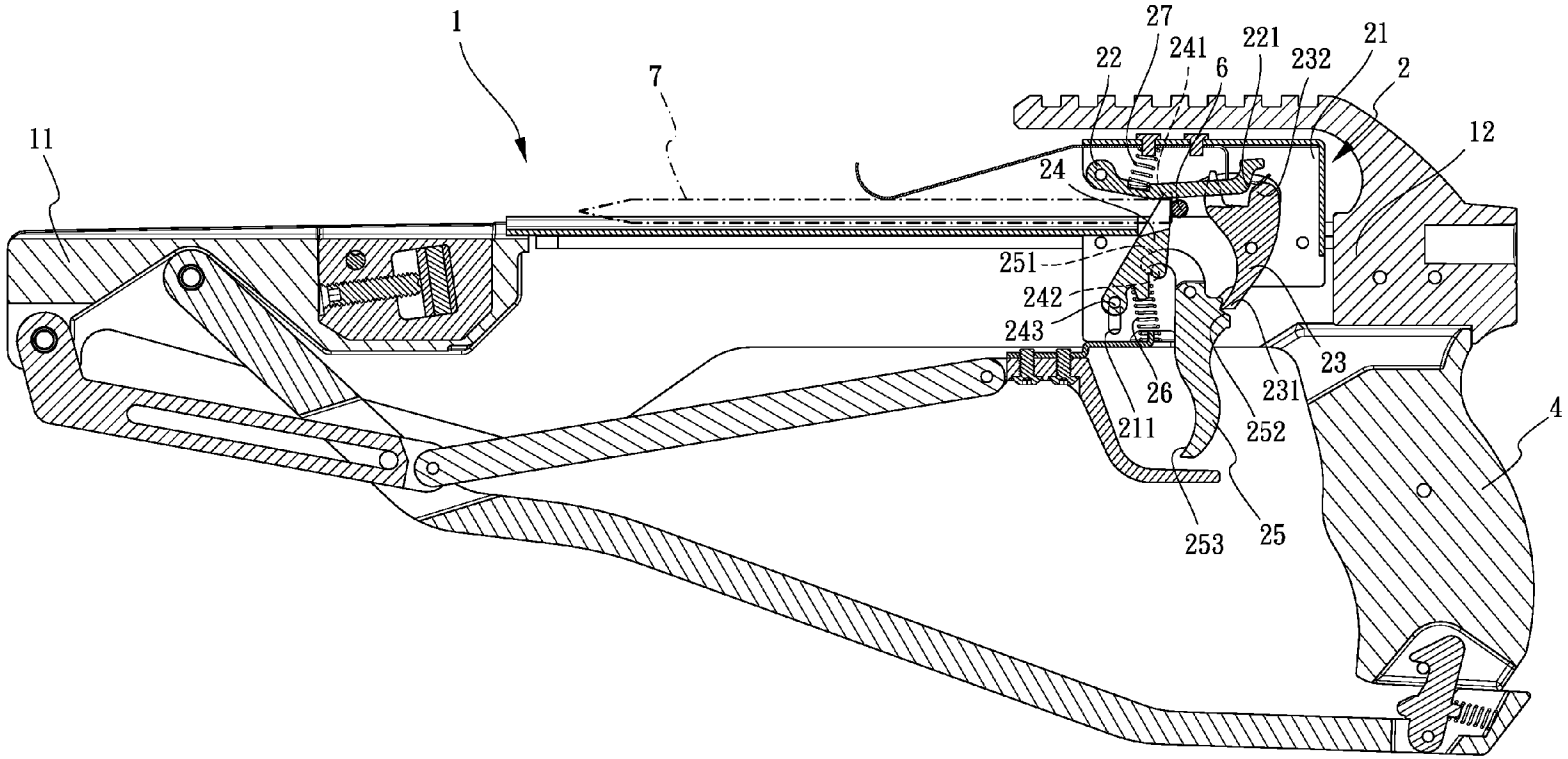
Figure 10:
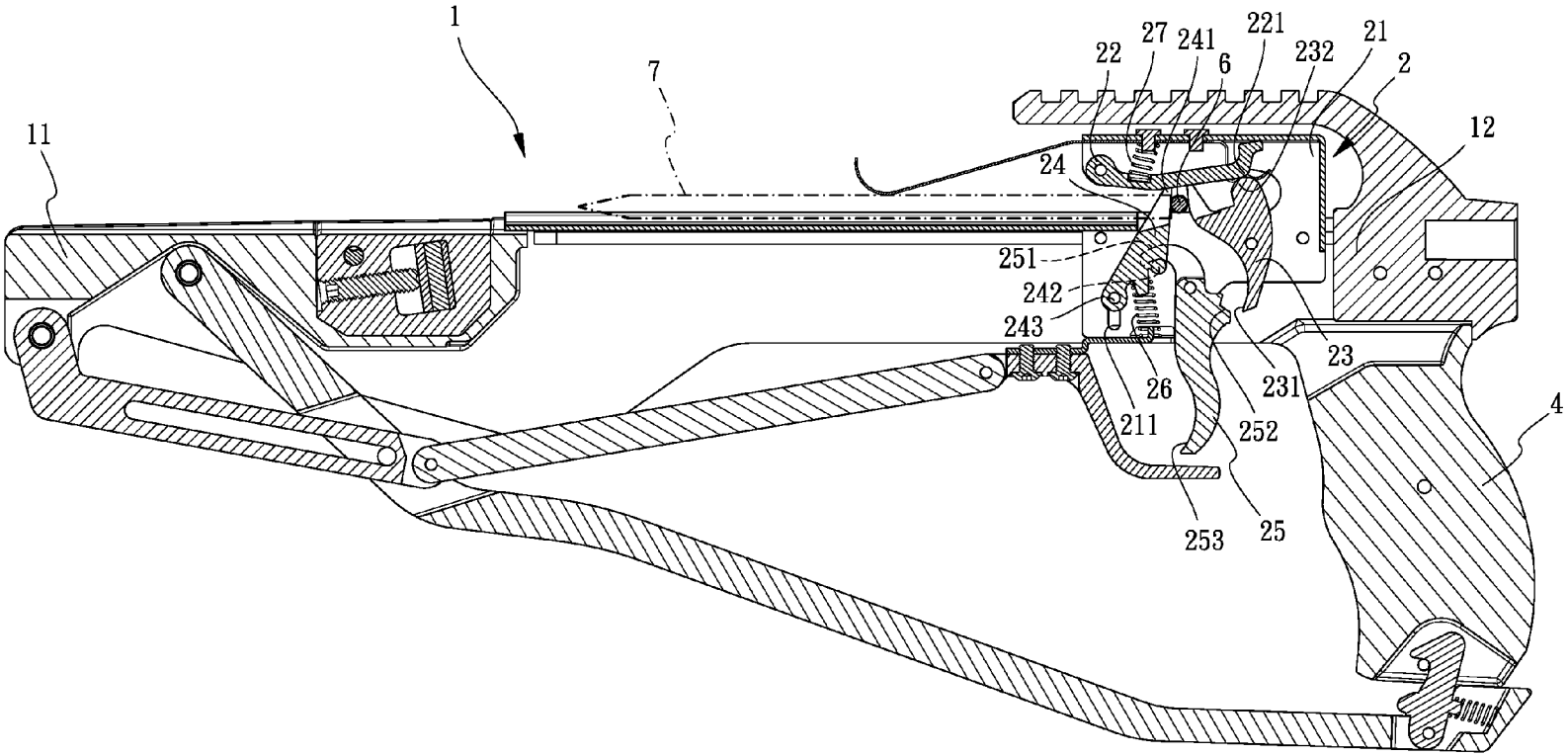
Figure 11:
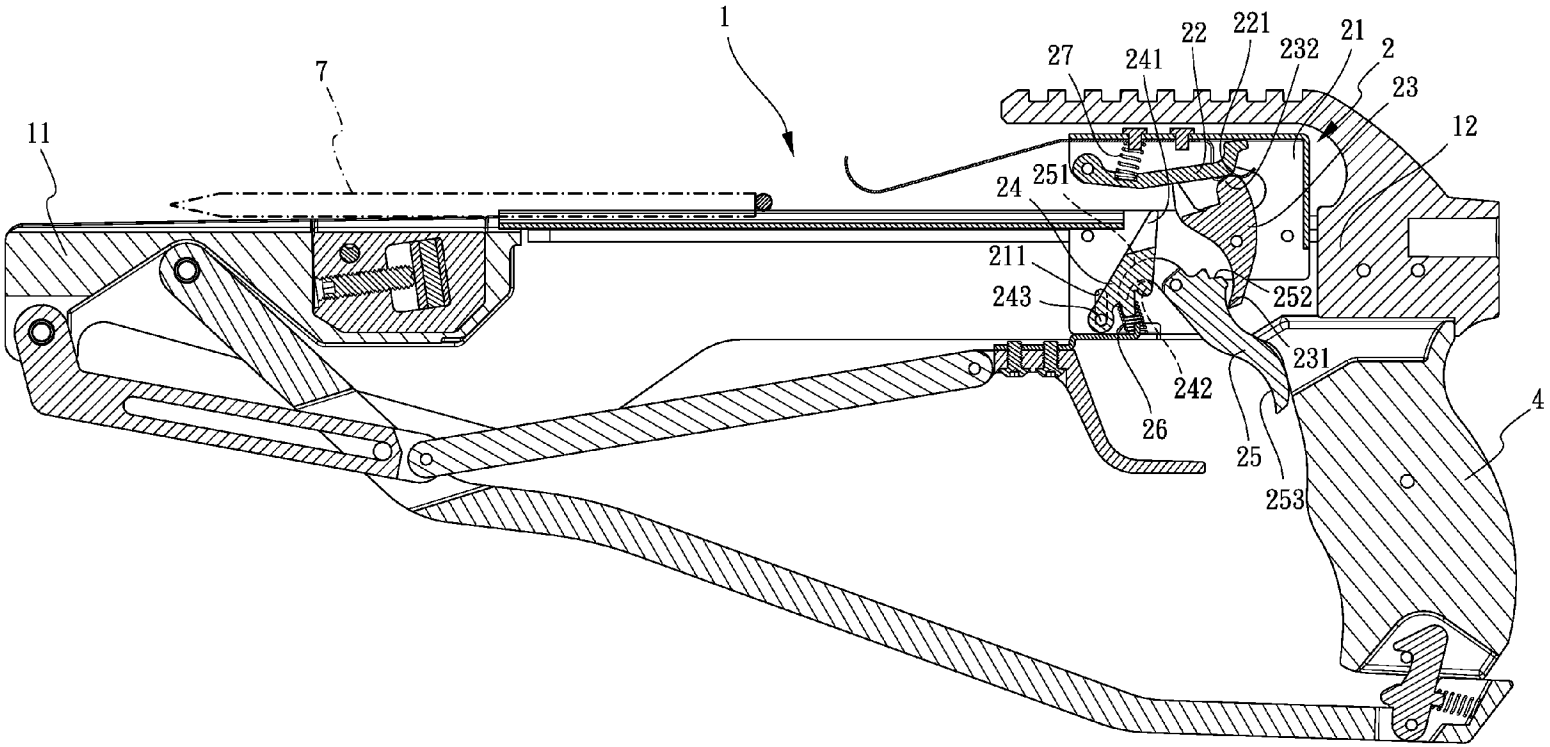

As shown in FIG. 4, the second end the pull rod 31 has a recess 313. A compression spring 34 is biased between the recess 313 and the pawl 312 to return the pawl 312.

As shown in FIG. 2, the pawl 312 has an inclined guide surface 3121 which guides the pawl 312 to connect to the pin 41 when the pull rod 31 is to be connected to the pin 41.

As shown in FIGS. 4-8, a plate 8 is connected to the slide 21 and located close to the trigger 25. The second end of the first link 33 is connected to a second link 331. At least one bolt 9 connects the second link 331 to the plate 8 so that when the pull rod 31 is moved, the action unit 2 is driven in the space 13.

The spanning unit 3 drives the action unit 2 to move in the space 13, so that when the hook member 24 hooks the string 6, the string 6 is easily pulled with less effort by using the leverage principle.

While we have shown and described the embodiment in accordance with the present invention, it should be clear to those skilled in the art that further embodiments may be made without departing from the scope of the present invention.

What is claimed is:

1. A spanning device of a crossbow, comprising:

a barrel having a front end and a rear end, a space defined in the barrel and located between the front end and the rear end, a grip connected to the rear end of the barrel, a limb connected close to the front end of the barrel, a string connected between two ends of the limb;

an action unit slidably located in the space and having a portion exposed from the space, the action unit having a slide, a restriction member, a safety member, a hook member and a trigger, the restriction member, the safety member, the hook member and the trigger connected to the slide which is slidably engaged with the space, the restriction member pressing the safety member to restrict the safety member from being pivoted, the safety member pressing the trigger to restrict the trigger from being pulled, the trigger having a first end connected to the hook member, a second end of the trigger being exposed from the space to be pressed to shoot;

a spanning unit having a pull rod, a pivotal rod and a first link, the pull rod having a first end thereof pivotably connected to the front end of the barrel, a second end of the pull rod detachably connected to the grip, the pivotal rod slidably connected to the pull rod, the pivotal rod having a first end pivotably connected to the front end of the barrel, a second end of the pivotal rod pivotably connected to a first end of the first link, a second end of the first link connected to the slide of the action unit;

wherein, when the second end of the pull rod is detached from the grip, the pull rod is pulled toward the front end of the barrel and drives the pivotal rod and the first link, the action unit moves within the space from the rear end toward the front end of the barrel to pivot the hook member backward by the string, the hook member returns to its initial position when the string moves over the hook member, the pull rod is pulled toward the rear end of the barrel and drives the pivotal rod and the first link to drive the action unit to move within the space from the front end toward the rear end, the hook member hooks the string and the string is pulled toward the rear end of the barrel, and the pull rod is connected to the grip, an arrow is installed to the barrel and contacts the string, the arrow contacts the restriction member, the restriction member releases restriction to the safety member so that the safety member is pushed toward the front end of the barrel to release restriction to the trigger, the trigger is pulled to pivot the hook member to release the string to shoot the arrow.

2. The spanning device of a cross bow as claimed in claim 1, wherein the slide has a first slot, the slide has a portion located in the space, and another portion of the slide is exposed from the space, the hook member has a hooked portion, an action rod and an operation member 243, the hooked portion hooks the string, the action rod is located between the hooked portion and the operation member, the operation member is located in the first slot, the trigger has a driving portion, a restriction area and a pull portion, the restriction area is located between the driving portion and the pull portion, the driving portion is connected to the action rod to drive the hook member, a recovery spring is located between the action rod and the operation member, the recovery spring is biased between the hook member and the slide, the recovery spring provides a force to return the hook member, the safety member has an engaging portion and a push portion, the engaging portion presses the restriction area of the trigger to restrict the trigger, the push portion controls the engaging portion to be engaged with or disengaged from the restriction area, the restriction member has a first end exposed from the space and a second end of the restriction member has a restriction portion which presses the push portion of the safety member to restrict the push portion, a resilient member is located between the slide and the restriction member so as to bias the restriction member to press the push portion of the safety member.

3. The spanning device of a cross bow as claimed in claim 2, wherein the space includes two sidewalls and each sidewall has a rail, the slide has multiple rods which are slidably engaged with the rails.

4. The spanning device of a cross bow as claimed in claim 3, wherein the pull rod has a pivot, the pivotal rod has a second slot, the pivot is slidably engaged with the second slot.

5. The spanning device of a cross bow as claimed in claim 1, wherein the first end of the pull rod has a pawl, the grip has a pin on an underside of the grip, the pawl is detachably connected with the pin.

6. The spanning device of a cross bow as claimed in claim 5, wherein the second end the pull rod has a recess, a compression spring is biased between the recess and the pawl to return the pawl.

7. The spanning device of a cross bow as claimed in claim 6, wherein the pawl has an inclined guide surface which guides the pawl to connect to the pin.

8. The spanning device of a cross bow as claimed in claim 1, wherein a plate is connected to the slide and located close to the trigger, the second end of the first link is connected to a second link, at least one bolt connects the second link to the plate so that when the pull rod is moved, the action unit is driven in the space.

* * * * *